US008899732B2

(12) United States Patent
Reinten et al.

(10) Patent No.: US 8,899,732 B2
(45) Date of Patent: Dec. 2, 2014

(54) INKJET PRINT HEAD HAVING A PIVOTABLY SUPPORTED MEMBRANE AND METHOD FOR MANUFACTURING SUCH A PRINT HEAD

(71) Applicant: OCE-Technologies B.V., Venlo (NL)

(72) Inventors: Hans Reinten, Velden (NL); Alex N. Westland, Baarlo (NL); René J. Van Der Meer, Venlo (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 14/279,583

(22) Filed: May 16, 2014

(65) Prior Publication Data

US 2014/0247309 A1 Sep. 4, 2014

Related U.S. Application Data

(63) Continuation of application No. PCT/EP2012/073161, filed on Nov. 21, 2012.

(30) Foreign Application Priority Data

Nov. 30, 2011 (EP) ..... 11191249

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/14233* (2013.01); *B41J 2/1607* (2013.01); *B41J 2002/14241* (2013.01)
USPC ..... 347/70; 347/68; 347/71

(58) Field of Classification Search
CPC ..... B41J 2/14209; B41J 2/14233; B41J 2/14282; B41J 2/1609; B41J 2/161; B41J 2/1614
USPC ..... 347/20, 54, 68.7–71
See application file for complete search history.

(56) References Cited

U.S. PATENT DOCUMENTS 6,343,853 B1 * 2/2002 Masubuchi et al. ..... 347/54
2004/0134068 A1 7/2004 Takahashi (Continued)

FOREIGN PATENT DOCUMENTS

EP 0 629 007 A1 12/1994
EP 0 838 336 A2 4/1998

(Continued)

*Primary Examiner* — Juanita D Jackson
(74) *Attorney, Agent, or Firm* — Birch, Stewart, Kolasch & Birch, LLP

(57) ABSTRACT

A print head comprises a pressure chamber in fluid communication with a nozzle and an actuator structure in operative communication with the pressure chamber for generating a pressure wave in the pressure chamber. The actuator structure comprises a membrane, wherein a first surface of the membrane forms a flexible wall of the pressure chamber and a piezo actuator, wherein the piezo actuator is arranged on a second surface of the membrane, the second surface being opposite of the first surface, such that the membrane is deformed at the position of the piezo actuator upon actuation of the piezo actuator. In the print head, the membrane is pivotably clamped between a first structure layer and a second structure layer such that the membrane pivots at the location of clamping upon deformation of the membrane due to actuation of the piezo actuator.

12 Claims, 8 Drawing Sheets

(56) References Cited

U.S. PATENT DOCUMENTS

| | | | |
|---|---|---|---|
| 2004/0140732 | A1 | 7/2004 | Truninger et al. |
| 2008/0018204 | A1 | 1/2008 | Sugahara |
| 2009/0109262 | A1 | 4/2009 | Cruz-Uribe et al. |

FOREIGN PATENT DOCUMENTS

| | | | |
|---|---|---|---|
| EP | 0 963 846 | A2 | 12/1999 |
| EP | 1 997 635 | A1 | 12/2008 |
| WO | WO 2005/037558 | A2 | 4/2005 |

* cited by examiner

INKJET PRINT HEAD HAVING A PIVOTABLY SUPPORTED MEMBRANE AND METHOD FOR MANUFACTURING SUCH A PRINT HEAD

FIELD OF THE INVENTION

The present invention generally pertains to a print head for ejecting droplets of a fluid, such as ink, wherein a flexible wall of a pressure chamber is deformed by actuation of a piezo actuator. The present invention further pertains to a method for manufacturing such a print head.

BACKGROUND ART

Print heads for ejecting droplets of fluid are commonly known as inkjet print heads. Such print heads may eject fluids like ink or any other fluids having suitable properties. Droplet ejection may be generated by a number of different kinds of methods. In a particular method, a piezo actuator is actuated to generate a pressure wave in a pressure chamber that is filled with the fluid to be ejected. The pressure chamber is in fluid communication with a nozzle of the print head and due to the generated pressure wave a droplet may be ejected through the nozzle.

Commonly, the piezo actuator is arranged on a membrane, which membrane forms a flexible wall of the pressure chamber. The piezo actuator is arranged on a surface of the membrane opposite of a surface that forms the wall of the pressure chamber, i.e. the piezo actuator is arranged outside the pressure chamber, although this is not required. In order to generate the pressure wave in the pressure chamber, the membrane is deformed by the piezo actuator. The membrane is deformed at the position of the piezo actuator, but as a consequence also at the position where the membrane is clamped, i.e. at the perimeter of the pressure chamber.

In order to have a dense arrangement of nozzles for high resolution printing, it is desirable to have small structures, including a small pressure chamber. Having a small pressure chamber and consequently a small membrane results in a relatively high stiffness of the membrane. In order to be able to expel droplets, a certain volume displacement is needed in the pressure chamber upon actuation. However, in view of the desired dense arrangement, it may require a relatively large actuation voltage to deform the relatively stiff membrane such that the needed volume displacement is achieved. Using a relatively large actuation voltage on the other hand decreases the lifetime of the piezo actuator, which is of course also not desirable.

In US2008/0018204 it is disclosed to have a bending-stiffness lowering portion. Such bending-stiffness lowering portion may include thinning of the membrane or providing of a through hole through the membrane outside an area that forms the flexible wall of the pressure chamber. Thus, stiffness of the membrane is reduced and bending is eased. However, it is desirable to reduce a resistance of the area of the membrane forming the flexible wall of the pressure chamber to actuation even further.

SUMMARY OF THE INVENTION

In an aspect of the present invention, a print head is provided. The print head is configured to eject a droplet of a fluid through a nozzle. The print head comprises a pressure chamber in fluid communication with the nozzle and an actuator structure in operative communication with the pressure chamber for generating a pressure wave in the pressure chamber. The actuator structure comprises a membrane, wherein a first surface of the membrane forms a flexible wall of the pressure chamber, and a piezo actuator, wherein the piezo actuator is arranged on a second surface of the membrane, the second surface being opposite of the first surface, such that the membrane is deformed at the position of the piezo actuator upon actuation of the piezo actuator. The membrane is pivotably supported such that the membrane pivots at the position of support upon deformation of the membrane due to actuation of the piezo actuator. In the print head according to the invention, the stiffness of the membrane is decreased by arranging the membrane such that at its position of support the membrane is enabled to pivot instead of—compared to the prior art—being deformed at a position of clamping. Compared to deforming the membrane, hinging the membrane about its point of support requires a significant less amount of energy and consequently a significantly lower actuation voltage is sufficient to induce a same volume displacement in the pressure chamber upon actuation.

In order to enable hinging, the membrane should be supported over a relatively short distance, viewed in the plane of the membrane in a direction substantially perpendicular to an adjacent wall of the pressure chamber. Further, the membrane may preferably have a free end arranged at or close to the position of support. Considering that the ink containing pressure chamber is arranged on one side of the position of support, the free end is arranged on an opposite side of the position of support in order to be able to fluidly close the pressure chamber using the pivotably supported membrane.

In an embodiment, the membrane is pivotably clamped between a first structure layer and a second structure layer. In a particular embodiment, the membrane is clamped between a first protrusion on the first structure layer and a second protrusion on the second structure layer. Such protrusion may for example be a metal track, or the like. The first and second protrusions may have predetermined contact area's such that a predetermined width of clamping is obtained. A small clamping width provides that the membrane may pivot instead of bend as above mentioned.

The membrane may be supported or clamped directly at a perimeter of the pressure chamber or may be supported or clamped at a predetermined distance from the perimeter, thereby increasing a flexibility of the membrane and hence a volume displacement of the actuator (or requiring a lower actuation voltage for a same volume displacement).

Depending on a desired functionality, at least the predetermined distance may be constant along the perimeter of the pressure chamber or the predetermined distance may vary.

The present invention further provides a method for manufacturing a print head configured to eject a droplet of a fluid through a nozzle by generating a pressure wave in a pressure chamber, which pressure chamber is in fluid communication with the nozzle, the pressure chamber having a piezo actuator arranged on a flexible wall of the pressure chamber, the method comprising providing a first structure layer; providing a membrane layer and bonding the membrane layer on the first structure layer; separating a part of the membrane layer from the membrane layer by patterning the membrane layer, said part being arranged and configured to become the flexible wall of the pressure chamber. In particular, an edge of said part of the membrane layer may be loosened from a remainder of the membrane layer such to enable free movement of such edge in a direction substantially perpendicular to a plane of the membrane layer. In an embodiment, the method further comprises providing a second structure layer and bonding the second structure layer on the membrane layer, thereby clamping the membrane part between the first structure layer and the second structure layer. Thus, a print head according to the present invention may be provided.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1A:
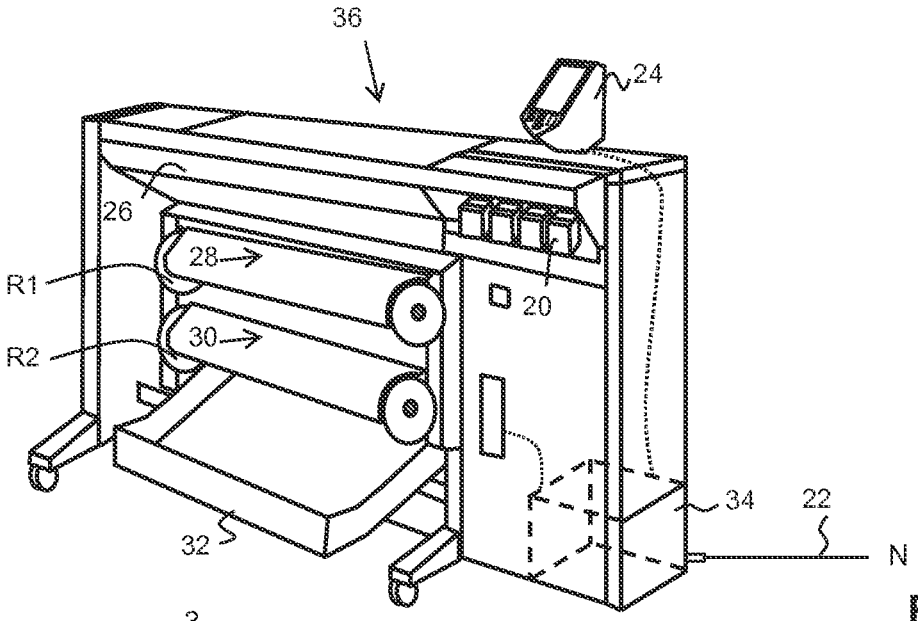
FIG. 1A shows a perspective view of an exemplary image forming apparatus.

The present invention will now be described with reference to the accompanying drawings, wherein the same reference numerals have been used to identify the same or similar elements throughout the several views.

Figure 1B:
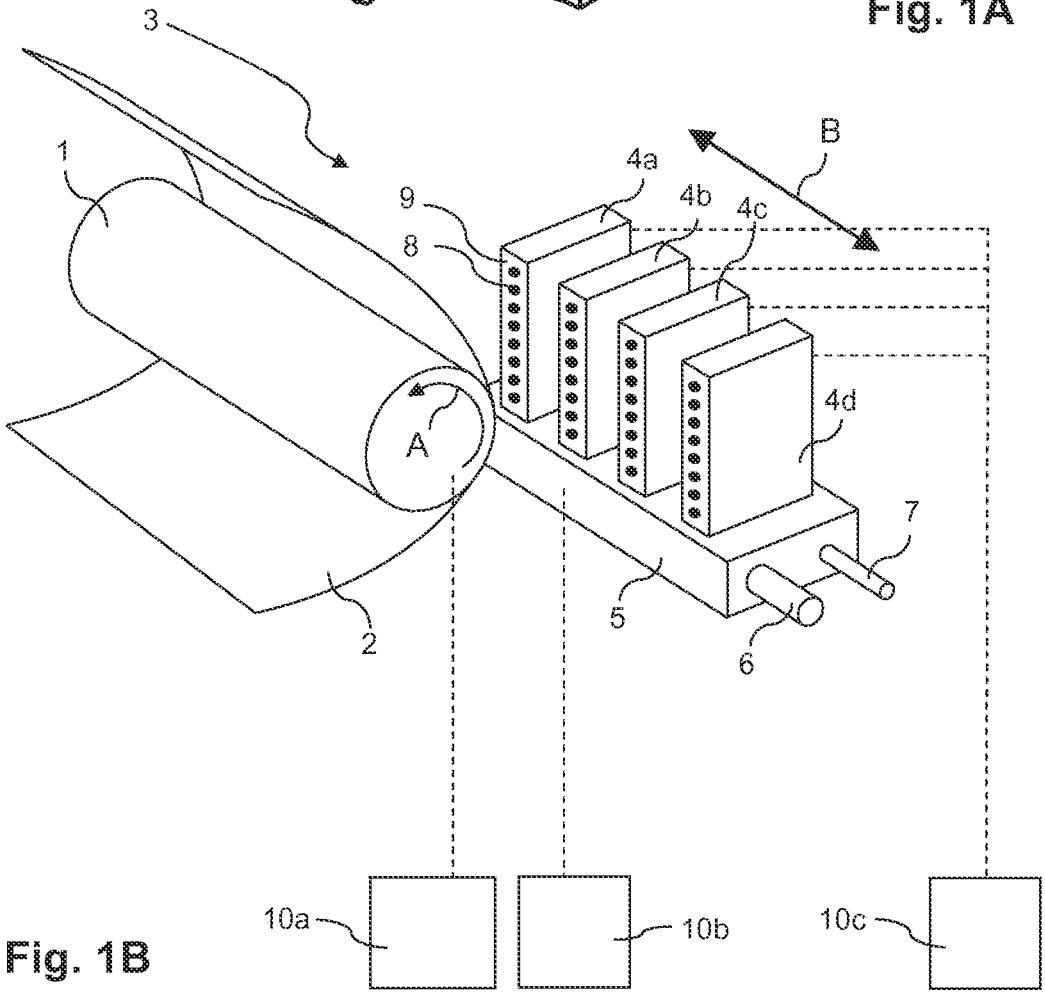
FIG. 1B schematically illustrates an embodiment of an inkjet printing system.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2.

For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

A print head according to the present invention may be employed in a printer as shown in FIG. 1A-1B, but may as well be used in a printer having statically arranged print heads. In such a printer the recording substrate moves continuously relatively to the print heads, while the print heads expel droplets at predetermined times to form an image on the image receiving member.

Figure 2A:
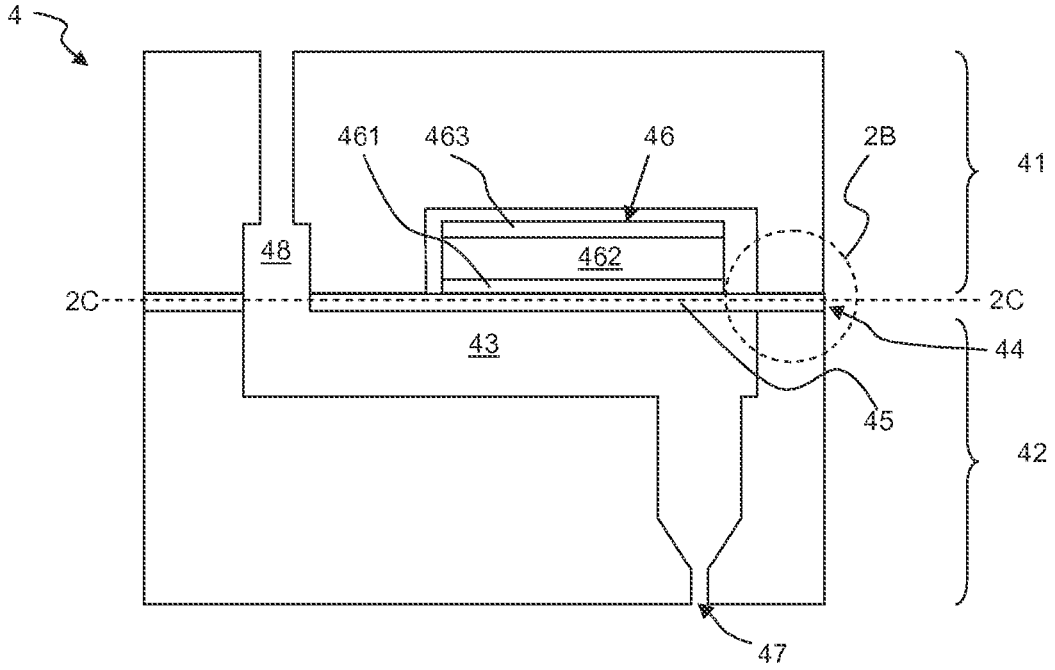
FIG. 2A-2C schematically illustrate a first embodiment of an inkjet print head according to the present invention.
Figure 2B:
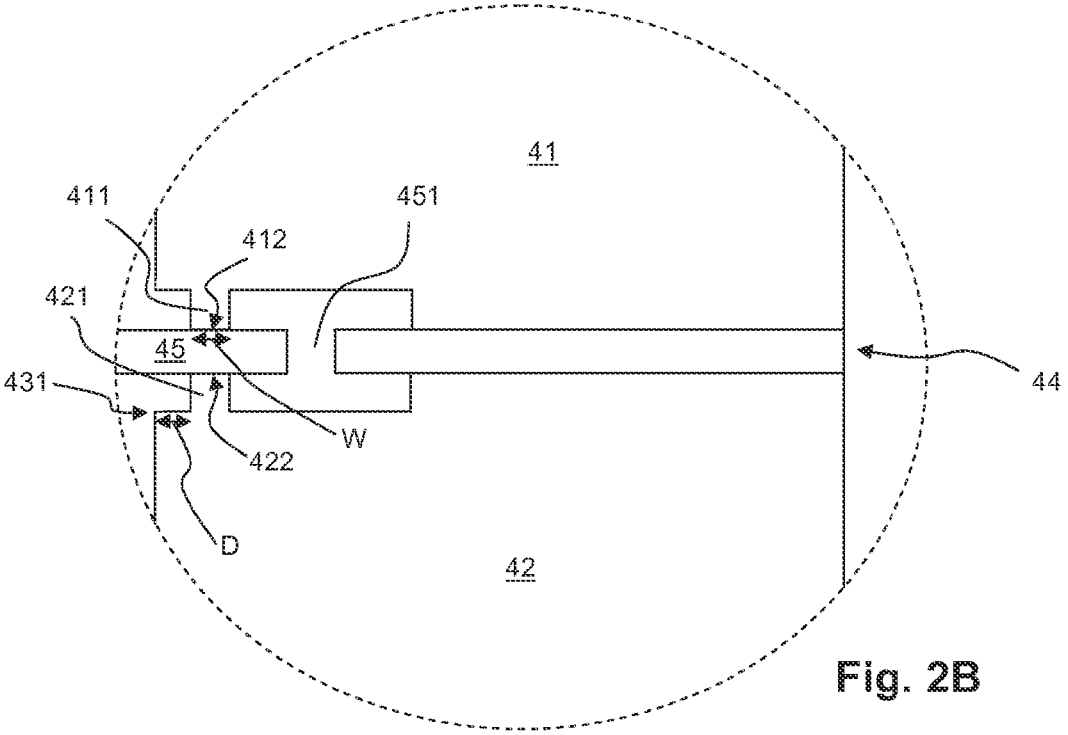
Figure 2C:
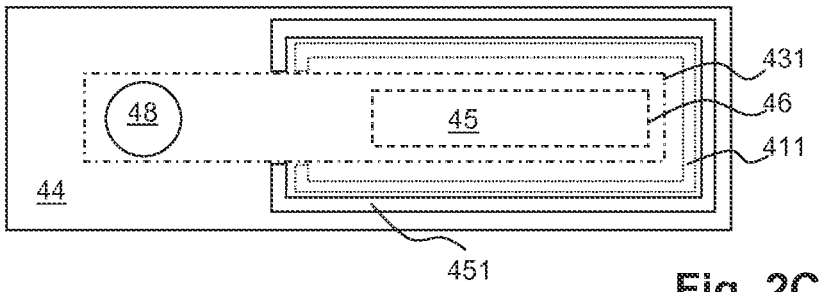

FIG. 2A-2C illustrate an embodiment of a print head 4 according to the present invention, comprising a first structure layer 41 and a second structure layer 42. An inlet channel 48 is provided in the first structure 41. A pressure chamber 43 and a nozzle 47 are arranged in the second structure layer 42. A membrane layer 44 is arranged between the first structure layer 41 and the second structure layer 42. A part of the membrane layer 44 is arranged and configured to form a membrane 45 of the print head 4. The membrane 45 forms a flexible wall of the pressure chamber 43. A piezo actuator 46 having a first electrode 461, a piezo material layer 462 and a second electrode 463, is arranged on a surface of the membrane 45 such that the piezo actuator 46 and the membrane 45 will bend if and when an actuation voltage is applied to the piezo actuator 46. Such bending results in a volume change of the pressure chamber 43, thereby generating a pressure wave in a fluid arranged in the pressure chamber 43. Due to the pressure wave a droplet of the fluid may be expelled through the nozzle 47. Note that in an embodiment the nozzle 47 may be provided in a further structure layer instead of in one of the first and the second structure layers 41, 42.

FIG. 2B illustrates a detailed view (the corresponding area indicated by B in FIG. 2A) of the clamping of the membrane 45 between the first and the second structure layers 41, 42. The membrane 45 is clamped between a first protrusion 411 and a second protrusion 421. The first and second protrusions 411, 421 are arranged at a predetermined distance D from a perimeter 431 of the pressure chamber 43. In an embodiment, such distance D may be zero. In the illustrated embodiment, the distance D is selected such that the membrane 45 is clamped at a distance D from the perimeter 431 not equal to zero in order to select a suitable flexibility of the membrane 45. Between the membrane 45 and the remaining material of the membrane layer 44 a void 451 is provided to enable an edge portion of the membrane 45 to move freely.

The first protrusion 411 and the second protrusion 421 have a first contact area 412 and a second contact area 422, respectively. The membrane 45 engages the first structure layer 41 at the first contact area 412 and engages the second structure layer 42 at the second contact area 422. A width W of the contact areas 412, 422, i.e. the dimension of the contact areas perpendicular to a direction in which the perimeter 431 of the pressure chamber 43 extends is suitably selected such that the membrane 45 will pivot between the first protrusion 411 and the second protrusion 421 upon actuation. In particular, the width W is preferably smaller than a thickness of the membrane in order to enable pivoting. The operation of the actuator 46 and membrane 45 are described in more detail hereinafter with reference to FIGS. 4A-4E.

FIG. 2C shows a cross-section of the print head 4 along the line C-C as indicated in FIG. 2A, i.e. a cross-section through the membrane layer 44 and the membrane 45. In FIG. 2C the membrane 45 is indicated including the void 451 surrounding the membrane 45. Such void 451 may have been provided by a patterning of the membrane layer 44, whereby the membrane 45 is (partly) separated from the membrane layer 44. Further, the inlet channel 48 running through the membrane layer 44 is illustrated. Dashed lines illustrate the position of other elements of the print head 4: the piezo actuator 46, the perimeter 431 of the pressure chamber 43 and the first protrusion 411. In the presently illustrated embodiment, the void 451 and the first protrusion 411 are interrupted at a position between the piezo actuator 46 and the inlet channel 48, since the pressure chamber 43, as indicated by its perimeter 431, extends from the inlet channel 48 to the piezo actuator 46 and, consequently, the second structure layer 42 does not provide a second contact area 422 to clamp the membrane 45 at that position. The membrane 45 may, for example, be bonded to the first structure layer 41 by use of a suitable adhesive, or the like, at that position.

Figure 2D:
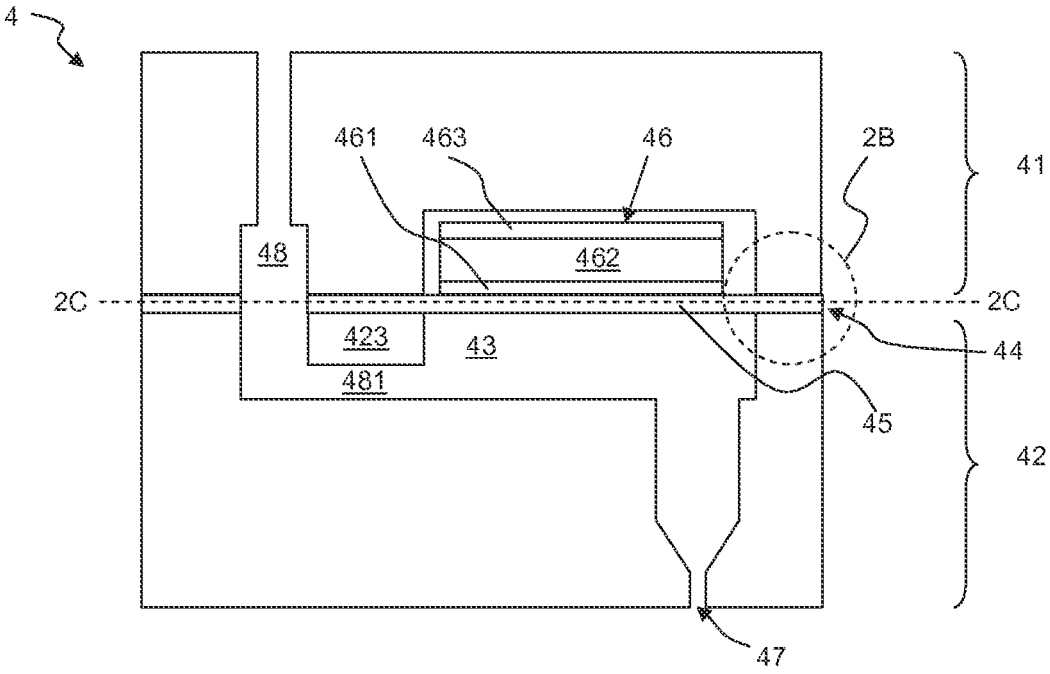
FIG. 2D schematically illustrates a second embodiment of an inkjet print head according to the present invention.

FIG. 2D shows a further embodiment of a print head 4 in accordance with the present invention, which embodiment is substantially similar to the embodiment of FIGS. 2A-2C. In the embodiment of FIG. 2D, however, a further structural element 423 is provided between the inlet channel 48 and the pressure chamber 43, thereby providing an inlet passage 481 between the inlet channel 48 and the pressure chamber 43. The further structural element 423 may be configured to clamp the membrane 45 in accordance with the present invention, e.g. corresponding to the clamping arrangement as shown in FIG. 2B or any one of the embodiments illustrated in FIGS. 4A-4E.

Figure 3A:
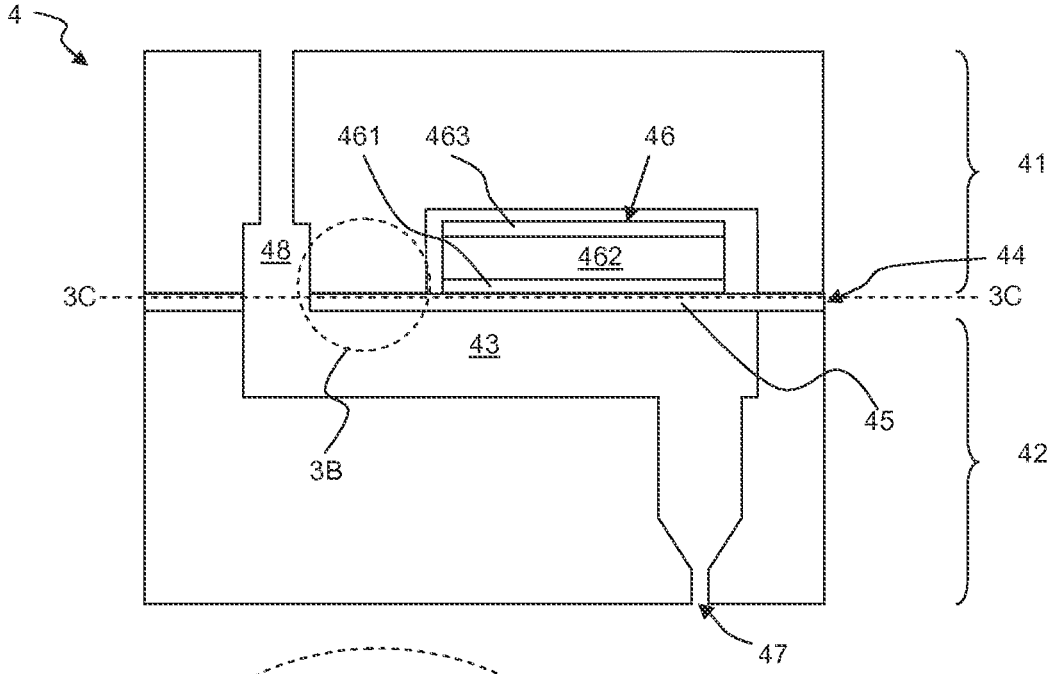
FIG. 3A-3C schematically illustrate a third embodiment of an inkjet print head according to the present invention.
Figure 3B:
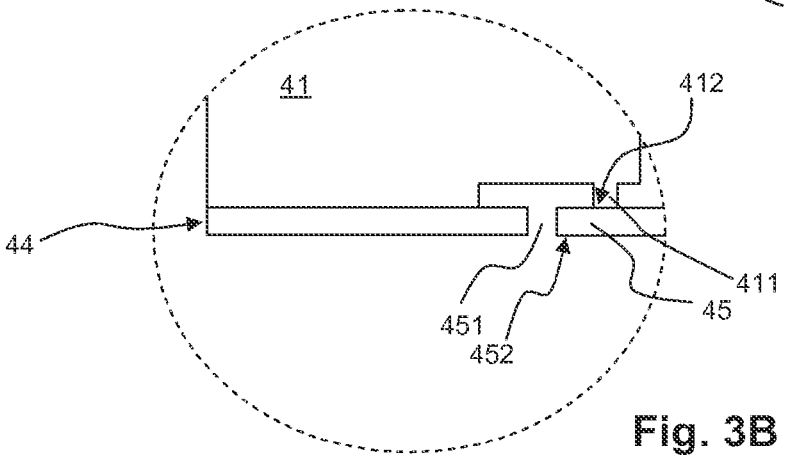
Figure 3C:
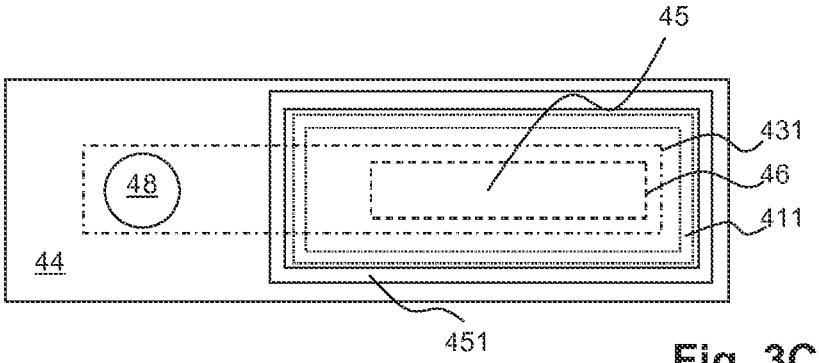

FIG. 3A-3C illustrates another embodiment of a print head 4 in accordance with the present invention. The basic structure as shown in FIG. 3A is identical to the embodiment illustrated in FIG. 2A. However, in the embodiment shown in FIG. 3A-3C, the membrane 45 is pivotably supported in accordance with the present invention also at a position between the position of the actuator 46 and the ink inlet 48. A difference between the embodiment of FIG. 2A-2C and the embodiment of FIG. 3A-3C is best seen by comparison of FIG. 2C and FIG. 3C. In FIG. 3C, both the void 451 and the first protrusion 411 run around the piezo actuator 45, while they are interrupted in FIG. 2C. As best seen in FIG. 3B, a consequence may be that the fluid to be ejected, e.g. ink, may flow through the void 451, thereby possibly influencing the movement of a free end 452 (free edge part) of the membrane 45. The free end (edge part) 452 of the membrane 45 improves and stimulates a pivotal movement instead of a bending movement at the clamping position.

A suitable coupling between the membrane 45 and the first protrusion 411 may be provided by a suitable adhesive. Such suitable adhesives are known in the art.

Figure 4A:
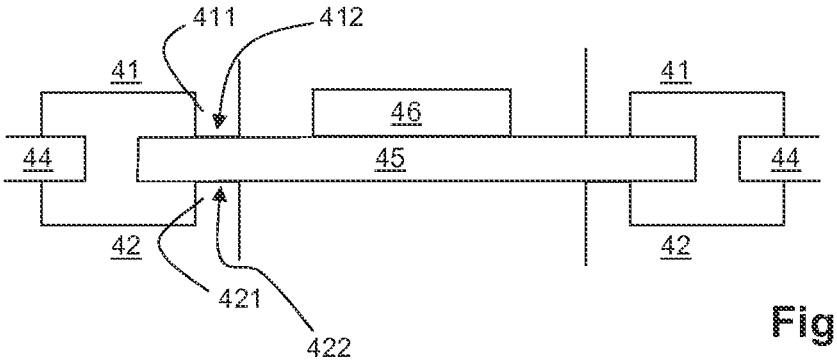
FIG. 4A-4B schematically illustrate a first embodiment of an arrangement of a membrane in an inkjet print head in accordance with the present invention.

FIG. 4A illustrates the membrane 45 and the piezo actuator 46 in rest as also illustrated in FIGS. 2A and 3. The membrane 45 is clamped between the first and second protrusions 411 and 421. The protrusions 411, 421 have similar contact area's 412, 422 and a similar position relative to the pressure chamber 43 such that the membrane 45 is engaged and clamped over the whole contact area's 412, 422.

Figure 4B:
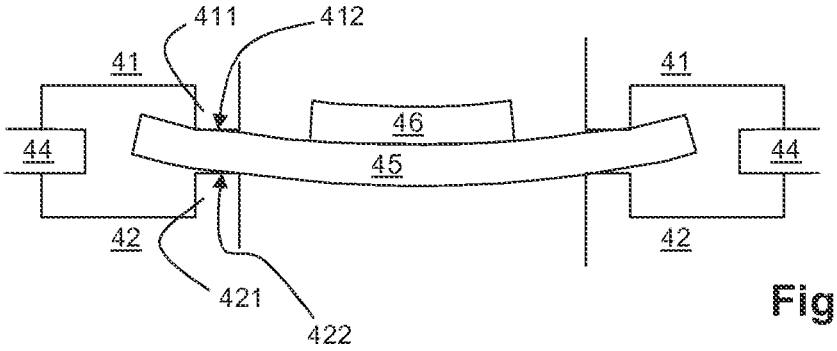

FIG. 4B illustrates the same embodiment as shown in FIG. 4A in a situation in which the piezo actuator 46 is in an actuated state. Due to an actuation voltage provided over the first and the second electrode 46*a*, 46*c*, the arrangement of piezo actuator 46 and membrane 45 bends. Depending on the polarity of the actuation voltage, the bending induces an enlargement of the pressure chamber volume or a reduction of the pressure chamber volume. In any case, due to the relatively small clamping area of the membrane 45 between the first and second protrusions 411, 421 the membrane 45 pivots at the clamping position as illustrated and does not need to bend at the clamping position. As hinging requires significantly less energy, the volume displacement induced by the actuation may be larger compared to a print head in which the membrane 45 has to bend at the clamping position. Similarly, inducing a same volume displacement requires a lower actuation voltage, which is advantageous in view of the expected lifetime of the piezo actuator 46, for example.

Figure 4C:
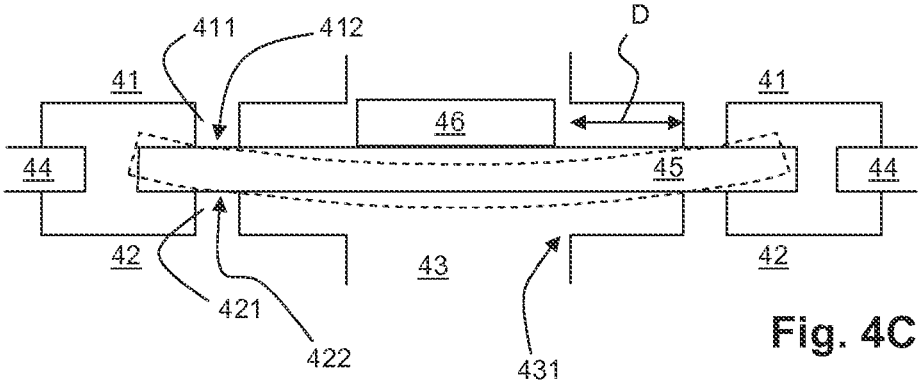
FIG. 4C schematically illustrates a second embodiment of an arrangement of a membrane in an inkjet print head in accordance with the present invention.

FIG. 4C illustrates a further embodiment, in which the compliance of the membrane 45 has been increased by positioning the clamping positions at a predetermined distance D from the perimeter 431 of the pressure chamber 43. Due to the larger distance between the clamping points of the membrane 45, the membrane 45 has a larger flexible dimension due to which bending requires less energy. It is noted that such support at a predetermined distance D from the perimeter 431 may as well be employed without the present invention. In particular, if the membrane 45 is supported such that it needs to bend upon actuation of the actuator 46 instead of to pivot at the point of support—in this embodiment between the first and the second protrusions 411 and 421—selecting a suitable distance between point of support and the perimeter 431 still enables to influence the compliance and thus to select a suitable compliance of the membrane 45.

Figure 4D:
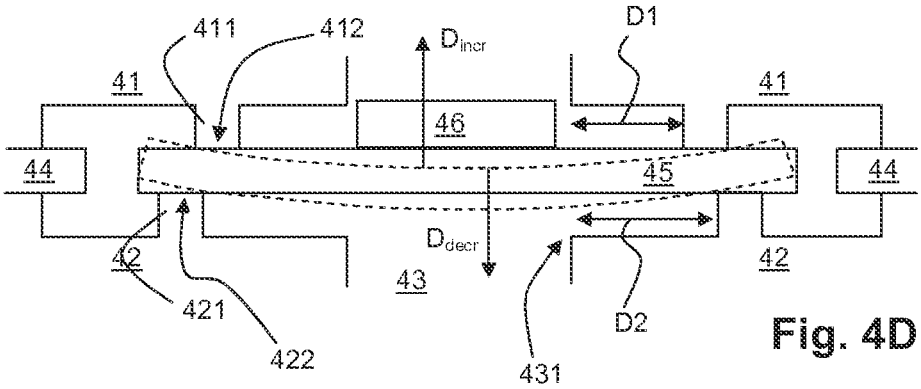
FIG. 4D schematically illustrates a third embodiment of an arrangement of a membrane in an inkjet print head in accordance with the present invention.

FIG. 4D illustrates a further embodiment, in which the first and second protrusions 411, 421 are arranged at a first distance D1 and a second distance D2, respectively, from the perimeter 431 of the pressure chamber 43 and therefore are only partly opposed to each other. Hence, a clamping area, i.e. the area of the membrane 45 actually being clamped, is smaller than a contact area 412, 422 of the membrane 45 (when in rest, i.e. not in an actuated state). As a result, the flexibility for bending in a first direction $D_{incr}$, i.e. the bending direction for increasing a volume of the pressure chamber 43, is different from the flexibility in a second direction $D_{decr}$, opposed to the first direction $D_{incr}$.

Moreover, in case the membrane 45 is actuated to bend in the first direction $D_{incr}$ to increase the volume of the pressure chamber 43, the membrane 45 pivots at the clamping position, while in case the membrane 45 is made to bend in the second direction $D_{decr}$ to decrease the volume of the pressure chamber 43, the membrane 45 is required to bend at the clamping position, further reducing the effectiveness of the actuation in view of displaced volume. In practice, the embodiment according to FIG. 4D may require specific considerations in order to allow the membrane 45 to move in accordance with the above description. For example, it may be considered to use a suitable adhesive to bond the membrane 45 only to the second protrusion 421 such that in the second direction $D_{decr}$ the pivotal movement of the membrane 45 is not negatively influenced by any bonding to the first protrusion 411.

Figure 4E:
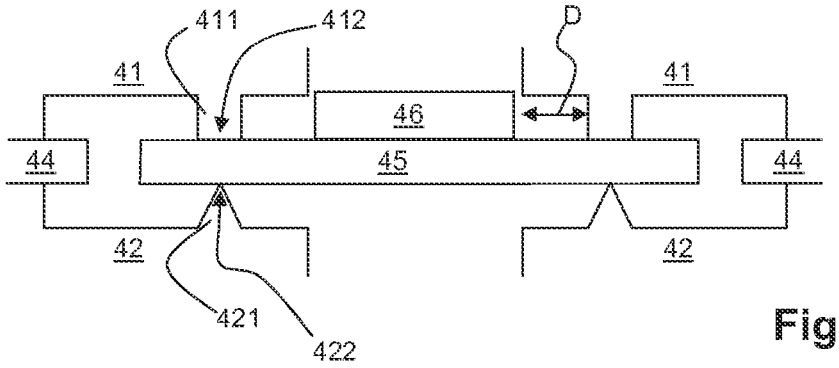
FIG. 4E schematically illustrates a fourth embodiment of an arrangement of a membrane in an inkjet print head in accordance with the present invention.

FIG. 4E illustrates an embodiment having a similar functioning as described in relation to FIG. 4D. The first protrusion 411 is triangularly shaped providing a small contact area 412. Moreover, the top of the triangular protrusion 411 may penetrate the membrane 45 slightly for providing a suitable closure of the pressure chamber 43 for retaining the liquid to be ejected in the pressure chamber 43, for example.

Figure 5A:
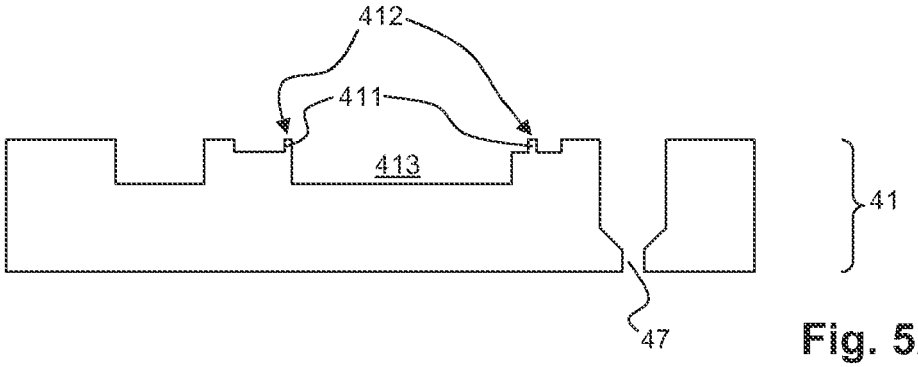
FIG. 5A-5E schematically illustrate an exemplary method for manufacturing an embodiment of a print head according to the present invention.

FIG. 5A-5E illustrate an embodiment of a method for manufacturing a print head in accordance with the present invention. In FIG. 5A, a first structure layer 41 is provided. In this embodiment, the first structure layer is provided with first recess 413 for receiving the piezo actuator therein. Further, the first structure layer 41 is provided with protrusion 411, having a contact area 412, arranged around the perimeter of a pressure chamber to be formed, while in another embodiment multiple separated protrusions may be used equally well provided that the resulting pressure chamber is closed to retain the liquid to be ejected in the pressure chamber. Further, an outlet structure comprising a nozzle 47 is provided.

Figure 5B:
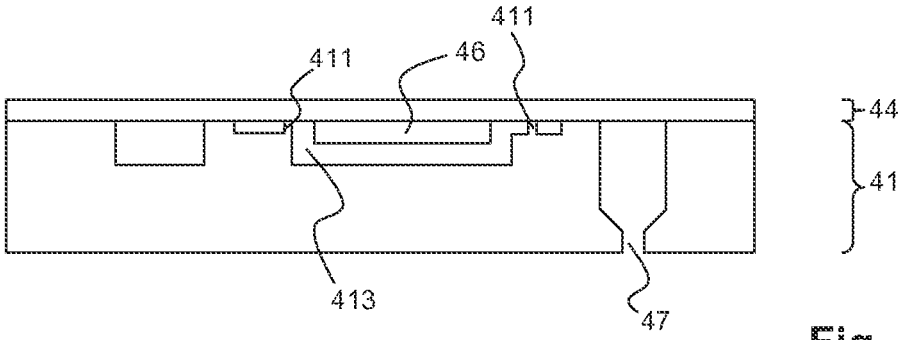

FIG. 5B shows the first structure 41 provided with a membrane layer 44 bonded to the first structure layer 41. The membrane layer 44 is provided with a piezo actuator 46, which may have been provided on the membrane layer 44 prior to bonding of the membrane layer 44 to the first structure layer 41. As illustrated the piezo actuator 46 is arranged in the first recess 413.

Figure 5C:
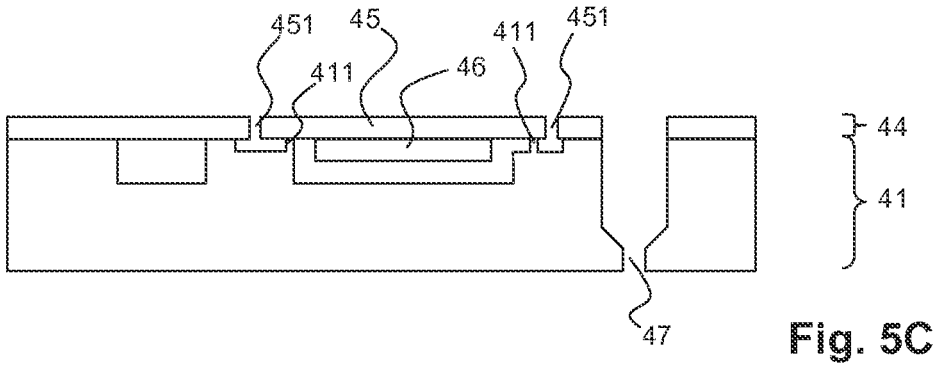

FIG. 5C illustrates that the membrane 45 has been separated from the remainder of the membrane layer 44, thereby providing voids 451. For example, common etch processing may be used to provide the voids 451 and thereby separate the membrane 45.

Figure 5D:
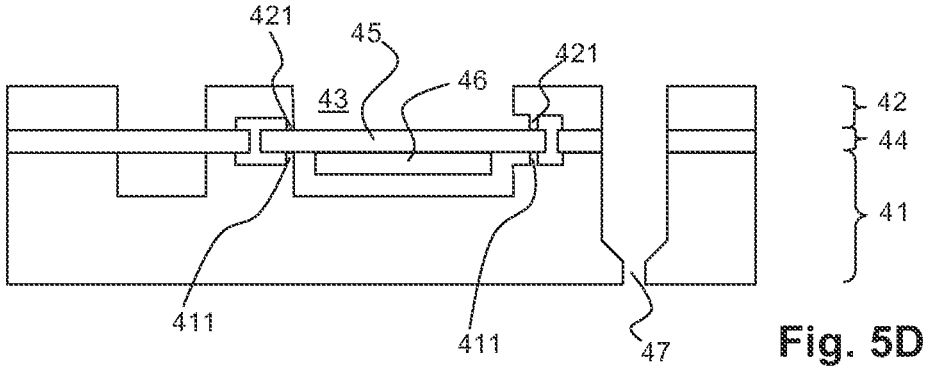

FIG. 5D illustrates the print head structure after providing a second structure layer 42, which comprises a recess that together with the membrane 45 forms the pressure chamber 43. The second structure layer 42 comprises the second protrusion 421 for clamping the membrane 45 between the first protrusion 411 and the second protrusion 421.

Figure 5E:
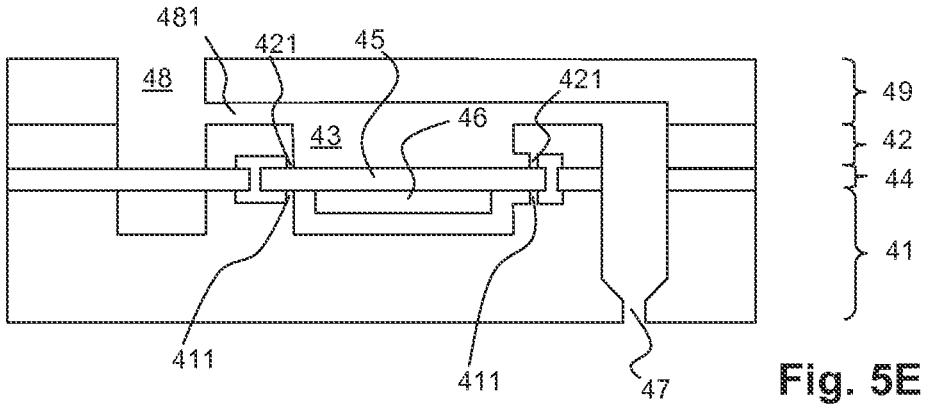

FIG. 5E shows the resulting print head 4 having been provided with a third structure layer 49 closing the pressure chamber 43 and thereby providing an inlet channel 48 and an inlet passage 481.

Figure 6:
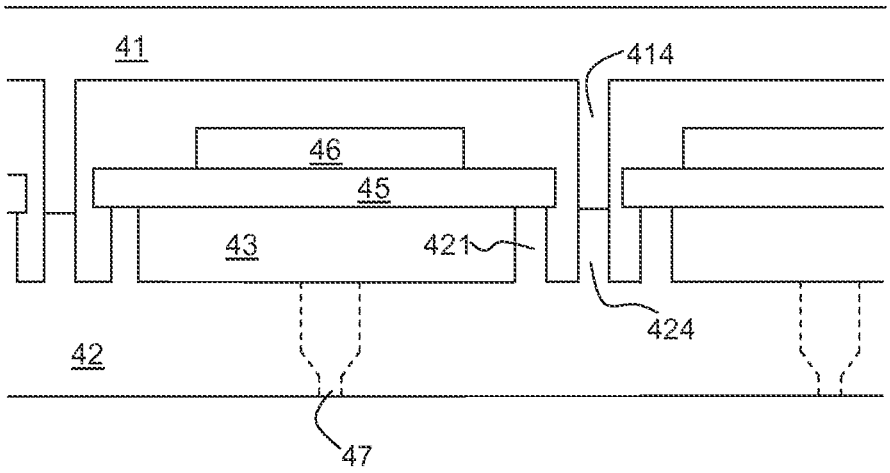
FIG. 6 schematically illustrates an embodiment of a print head in accordance with the present invention.

FIG. 6 illustrates an embodiment of a print head having an array of pressure chambers 43, each in communication with an associated nozzle 47. A membrane 45 is arranged over each pressure chamber 43 and a piezo-actuator 46 is arranged on the membrane 45. The membrane 45 is supported on a second protrusion 421 of a second structure layer 42 in accordance with the present invention. In this embodiment, the second protrusion 421 forms a wall of the pressure chamber 43. The second structure layer 42 is further provided with a second support protrusion 424. A first structure layer 41 is provided with a first support protrusion 414.

The first support protrusion 414 of the first structure layer 41 is arranged on the second support protrusion 424 of the second structure layer 42, thereby forming the basic print head structure. The first support protrusion 414 and the second support protrusion 424 are arranged such that at least one of the first support protrusion 414 and the second support protrusion 424 extend through an opening between the membrane 45 and an adjacent membrane. However, in an embodiment, a remainder of a membrane layer (cf. membrane layer 44 in FIG. 5B-5E) may be arranged between the first support protrusion 414 and the second support protrusion 424 such that remainder of the membrane layer will be in such opening between membranes 45.

Thus, in the embodiment of FIG. 6, each droplet generating assembly, i.e. an assembly of a pressure chamber 43, an associated membrane 45, an associated piezo actuator 46 and an associated nozzle 47, is provided with a separated membrane 45. Please note that such an array of droplet generating assemblies in a print head may also be provided without employing the present invention.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A print head configured to eject a droplet of a fluid through a nozzle, the print head comprising:

a pressure chamber in fluid communication with the nozzle; and an actuator structure in operative communication with the pressure chamber for generating a pressure wave in the pressure chamber; the actuator structure comprising a membrane, wherein a first surface of the membrane forms a flexible wall of the pressure chamber; and a piezo actuator, wherein the piezo actuator is arranged on a second surface of the membrane, the second surface being opposite of the first surface, such that the membrane is deformed at the position of the piezo actuator upon actuation of the piezo actuator, wherein the membrane is pivotably supported such that the membrane pivots at the location of support upon deformation of the membrane due to actuation of the piezo actuator.

2. A print head according to claim 1, wherein the membrane is supported on a contact area provided by a surface of a protrusion of a structure layer at a predetermined distance from a perimeter of the pressure chamber.

3. A print head according to claim 2, wherein the predetermined distance is constant along the perimeter of the pressure chamber.

4. A print head according to claim 2, wherein the protrusion is formed from metal.

5. A print head configured to eject a droplet of a fluid through a nozzle, the print head comprising:

a pressure chamber in fluid communication with the nozzle; and an actuator structure in operative communication with the pressure chamber for generating a pressure wave in the pressure chamber; the actuator structure comprising a membrane, wherein a first surface of the membrane forms a flexible wall of the pressure chamber, and a piezo actuator, wherein the piezo actuator is arranged on a second surface of the membrane, the second surface being opposite of the first surface, such that the membrane is deformed at the position of the piezo actuator upon actuation of the piezo actuator, wherein the membrane is pivotably supported such that the membrane pivots at the location of support upon deformation of the membrane due to actuation of the piezo actuator, and, wherein the membrane is pivotably clamped between a first structure layer and a second structure layer.

6. A print head according to claim 5, wherein the first structure layer has a first contact area engaging the membrane and wherein the second structure layer has a second contact area engaging the membrane, the membrane being clamped between at least a part of the first contact area and at least a part of the second contact area.

7. A print head according to claim 6, wherein the first contact area is provided by a surface of a first protrusion of the first structure layer at a first predetermined distance from a perimeter of the pressure chamber; and the second contact area is provided by a surface of a second protrusion of the second structure layer at a second predetermined distance from the perimeter of the pressure chamber.

8. A print head according to claim 7, wherein at least one of the first predetermined distance and the second predetermined distance is constant along the perimeter of the pressure chamber.

9. A print head according to claim 7, wherein the first predetermined distance and the second predetermined distance are equal for each position along the perimeter of the pressure chamber.

10. A print head according to claim 7, wherein at least one of the first protrusion and the second protrusion is formed from metal.

11. A method for manufacturing a print head configured to eject a droplet of a fluid through a nozzle by generating a pressure wave in a pressure chamber, which pressure chamber is in fluid communication with the nozzle, the pressure chamber having a piezo actuator arranged on a membrane forming a flexible wall of the pressure chamber, the method comprising:

providing a structure layer;

providing a membrane layer and bonding the membrane layer on the first structure layer;

separating a part from the membrane layer, said part being arranged and configured to form the membrane.

12. A method according to claim 11, wherein the method further comprises the step of providing a second structure layer and bonding the second structure layer on the membrane layer, thereby clamping the membrane part between the first structure layer and the second structure layer.

* * * * *